US007766769B2

(12) United States Patent
Lueders

(10) Patent No.: US 7,766,769 B2
(45) Date of Patent: Aug. 3, 2010

(54) MULTI-FUNCTIONAL GOLF TOOL

(76) Inventor: Robert Lueders, 21545 W. 122nd Ter., Olathe, KS (US) 66081

( * ) Notice: Subject to any disclaimer, the term of this patent is extended or adjusted under 35 U.S.C. 154(b) by 83 days.

(21) Appl. No.: 11/985,571

(22) Filed: Nov. 15, 2007

(65) Prior Publication Data

US 2009/0163300 A1 Jun. 25, 2009

Related U.S. Application Data

(60) Provisional application No. 60/859,267, filed on Nov. 15, 2006.

(51) Int. Cl.
*A63B 57/00* (2006.01)

(52) U.S. Cl. ..... 473/408; 224/666

(58) Field of Classification Search ..... 473/408, 473/406, 286, 285; 224/666, 918
See application file for complete search history.

(56) References Cited

U.S. PATENT DOCUMENTS

| | | | | | |
|---|---|---|---|---|---|
| 3,977,674 | A | * | 8/1976 | Zeller | 473/285 |
| 4,129,237 | A | * | 12/1978 | Grinder | 224/918 |
| 4,535,987 | A | * | 8/1985 | Dikoff | 473/408 |
| 4,736,877 | A | * | 4/1988 | Clark | 224/666 |
| 4,974,842 | A | * | 12/1990 | Widman | 473/406 |
| 4,984,790 | A | * | 1/1991 | Dowdy et al. | 473/408 |
| 5,022,650 | A | * | 6/1991 | Madock | 473/408 |
| 5,121,519 | A | * | 6/1992 | Haugom | 473/408 |
| 5,226,647 | A | | 7/1993 | Notarmuzi | |
| 5,244,204 | A | * | 9/1993 | Zeller | 473/285 |
| 5,269,513 | A | * | 12/1993 | Gervais | 473/408 |
| 5,305,999 | A | * | 4/1994 | Tate | 473/406 |
| 5,393,052 | A | | 2/1995 | Kennedy | |
| 5,529,299 | A | | 6/1996 | Bellagamba | |
| 5,573,167 | A | * | 11/1996 | Bebb et al. | 224/666 |
| 6,004,229 | A | | 12/1999 | Fazekas | |
| 6,030,298 | A | * | 2/2000 | Tate | 473/408 |
| 6,033,322 | A | | 3/2000 | England | |
| 6,224,502 | B1 | * | 5/2001 | Warfield | 473/408 |

(Continued)

*Primary Examiner*—Steven Wong
(74) *Attorney, Agent, or Firm*—Mark D. Bowen, Esq.; Malin Haley DiMaggio Bowen & Lhota, P.A.

(57) ABSTRACT

An improved multi-functional golf tool having a handle portion formed at its proximal end, and a pair of prongs formed at its distal end and disposed in angular relation with the handle to facilitate the pivotal movement of the golf tool in repairing ball marks or other irregularities on the playing turf, and further providing pivotal leverage when the tool is reversed to aid in removing tees embedded in the ground is disclosed. The handle portion includes a top adapted to removably receive a ball mark. The handle includes a top side that defines a longitudinally aligned, generally U-shaped structure disposed at the handle distal end thereof approximately mid-length on the device that serves multiple functions, such as a thumb-rest, cigar holder, and club grip holder. In a corresponding position on the bottom side of the device a contoured surface runs in a transverse direction thereby providing a comfortable support for the user's index finger. The proximal end of the handle includes a projecting tab that functions as a club face scraper for removing dirt and debris, as well functioning as an opening tool for use with ring-pull tab opening mechanisms commonly found on aluminum drinking cans. The projecting tab further includes opposing left and right thin edge projections that function as clubface groove cleaning structures. Alternate embodiments including a belt clip holder and hat visor clip holder are also disclosed.

6 Claims, 6 Drawing Sheets

U.S. PATENT DOCUMENTS

| | | | | |
|---|---|---|---|---|
| D452,544 | S | 12/2001 | Bato | |
| D463,522 | S | 9/2002 | Goessling, Jr. | |
| D470,556 | S | 2/2003 | Guerette | |
| 6,514,159 | B2 | 2/2003 | Hendren | |
| 6,565,458 | B1 | 5/2003 | Cameron | |
| 6,645,092 | B1 | 11/2003 | Hendren | |
| 6,994,639 | B2 | 2/2006 | Parks | |
| D518,864 | S | 4/2006 | Bradshaw | |
| 7,070,519 | B2 | 7/2006 | Bellagamba | |
| 7,238,126 | B1 * | 7/2007 | Wiens et al. | 473/408 |
| 2001/0029213 | A1 | 10/2001 | Hendren | |
| 2002/0115507 | A1 | 8/2002 | Gribovsky | |
| 2002/0153395 | A1 * | 10/2002 | Martinez | 224/666 |
| 2004/0142773 | A1 | 7/2004 | Kennedy | |
| 2005/0037873 | A1 | 2/2005 | Kennedy | |
| 2006/0073917 | A1 | 4/2006 | Johnson | |
| 2007/0082758 | A1 * | 4/2007 | Widmann | 473/406 |
| 2007/0111826 | A1 * | 5/2007 | Blanks | 473/408 |
| 2007/0149325 | A1 * | 6/2007 | Vargas | 473/408 |
| 2008/0125251 | A1 * | 5/2008 | Sheehan | 473/406 |

* cited by examiner

FIG. 9
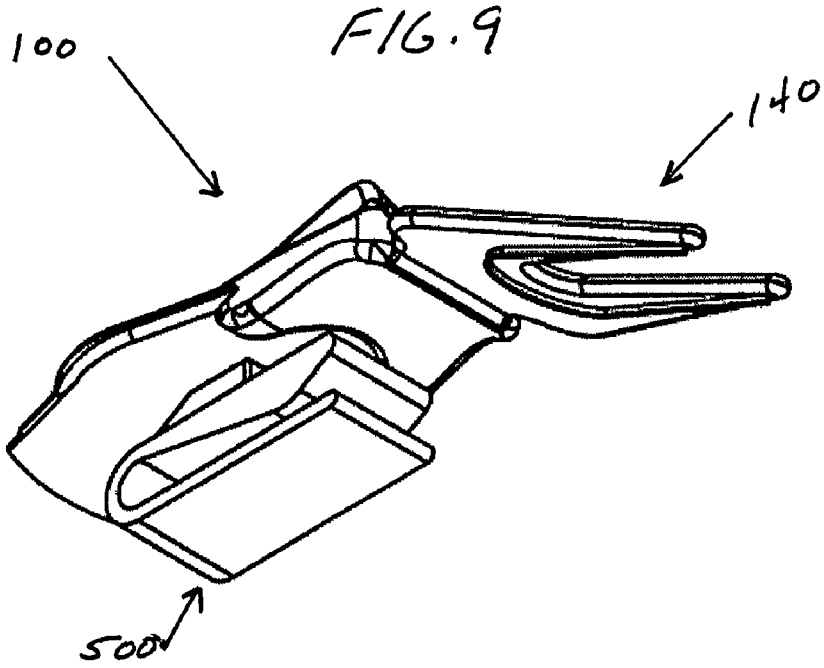
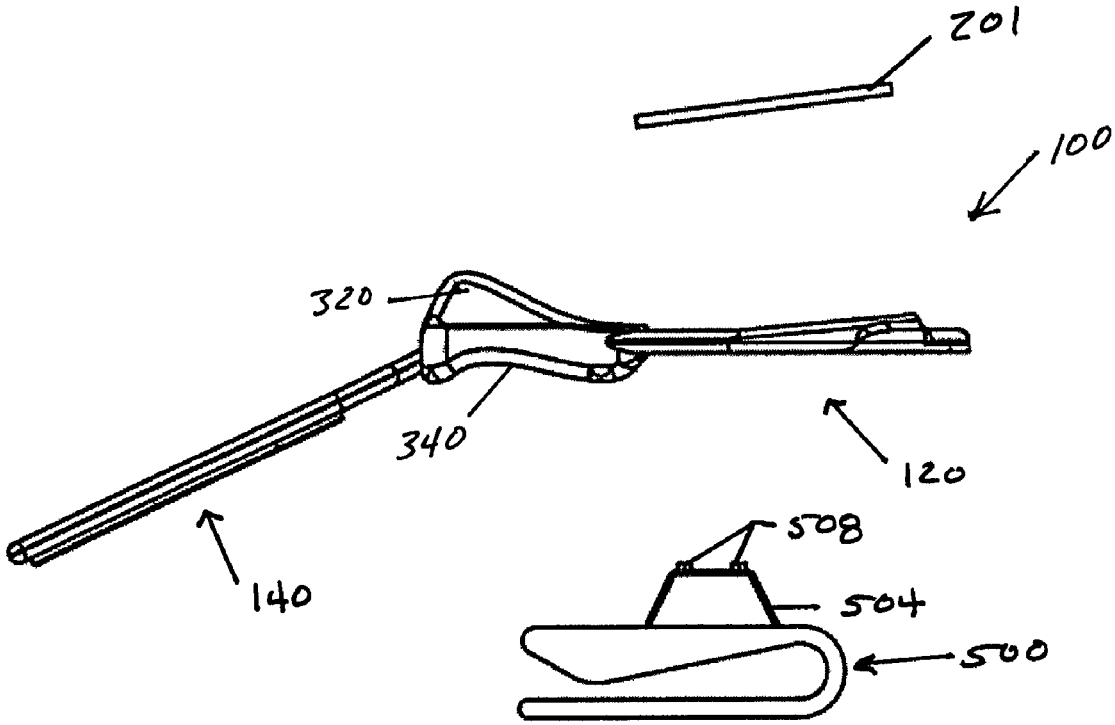
FIG. 10

MULTI-FUNCTIONAL GOLF TOOL

CROSS REFERENCE TO RELATED APPLICATIONS

This application claims the benefit of provisional U.S. Patent Application Ser. No. 60/859,267, filed on Nov. 15, 2007.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates to golf accessories, and more particularly to a multi-functional tool for use by golfers during preparation for and playing rounds of golf.

2. Description of Related Art

The game of golf has been described as both deceptively simple and endlessly complicated. For many reasons this description accurately describes the game of golf. The game of golf requires that a golfer engage in a variety of activities during the preparation and actual playing of the round. For example, prior to playing an actual round the player will typically clean the spikes on his golf shoes and grooves in his clubs. While playing a round, the golfer normally engages in a host of repetitive activities, many of which may be aided by the use of tools. These activities including cleaning golf spikes, clubfaces, clubface grooves etc. In addition, the golfer is strongly encouraged to repair ball marks, e.g. impact impressions, made on the green by an incoming shot. The golfer must remove stubbornly embedded tees, particularly those driven deeper into the teeing ground by the club during the execution of a stroke. Since golf is played outdoors, the golfer must also contend with the elements. It is well known that wet conditions, for example, can create considerable difficulties for a golfer should the grips of the clubs become wet and thereby degrade the golfer's ability to control twisting forces affecting the club. As a result, the golfer typically makes every effort to maintain dry grips. Furthermore, while many golfers enjoy a fine cigar while playing, most prefer not to execute actual golf strokes with a cigar dangling from their mouth. As a result, golfer's who smoke during the round are often searching for a dry place to temporarily set their cigar in order to execute a shot.

The variety of diverse activities engage in by a golfer before, during, and after a round has resulted in a number of attempts in the art to provide golfer's tool that is multi-functional so as to be useful in a variety of activities. For example, U.S. Pat. No. 5,121,519, issued to Haugom, discloses a cleaning device that is particularly suited for cleaning the grooves of a golf club and repairing ball mark depressions. U.S. Pat. No. 5,226,647, issued to Notarmuzi, discloses a multi-purpose golfer's accessory with a straight edge defining a scraper, and a pair of prongs providing a green repair tool. U.S. Pat. No. 5,393,052, issued to Kennedy, discloses a golfing tool for divot repair, club holding, and ball mark repair. U.S. Pat. No. 5,529,299, issued to Bellagamba, discloses a golf accessory with a divot tool having a removable marker and a golf club shaft cradle. U.S. Pat. No. 6,004,229, issued to Fazekas, discloses a golf tool having a magnetic post within a round recess for holding a round metallic ball marker, a jagged front edge for cleaning golf club grooves, and a pair of prongs that function to repair turf and as a spike wrench. U.S. Pat. No. 6,033,322, issued to England, discloses a golf tool for holding a ball marker and for repairing divots. U.S. Pat. No. 6,224,502, issued to Warfield, discloses an implement for repairing ball marks. The device includes an abutment that provides a surface against which an index finger of a user can rest to apply increased pressure to insert the implement into the green. U.S. Pat. No. 6,565,458, issued to Cameron, discloses a turf repair device having an angularly disposed first and second portions and a pivot point disposed therebetween. U.S. Pat. Nos. 6,514,159 and 6,645,092, issued to Hendren, disclose a golf tool having pivotal support arms for selectively supporting golf club grips off the grass. U.S. Pat. No. 6,994,639, issued to Parks et al., discloses a golf accessory including a magnetic surface in combination with a rest for an object, such as a cigar, using a fixed plate and a hinged plate. U.S. Pat. No. 7,070,519, issued to Bellagamba, discloses a divot tool having a ball marker insertably received through edge openings.

In addition, a number of published patent applications disclose further improvements in the art. For example, Pub. No. US 2002/0115507, in the name of Gribovsky, discloses a ballmark repair tool including a handle portion and a curved shovel portion projecting from the handle portion. Pub. No. US 2004/0142773, in the name of Kennedy, discloses a golf divot repair tool that includes a holder for markers wherein an opening is provided in the holder to allow the golfer to release the ball marker from the holder. Pub. No. US 2006/0073917, in the name of Johnson, discloses a divot repair tool that relies on magnetic force to automatically link the tool and ball mark together when they are deposited separately in the golfer's pocket.

A number of design patents also disclose various ornamental designs for golf tools. Included among those disclosures are the following design patents: U.S. D518,864; U.S. D470,556; U.S. D463,522; and U.S. D452,544; U.S. D419,631.

The present inventor notes that prior contributors to the art have used several significant golf terms at variance with accepted definitions. For the purpose of the present application the following accepted definitions shall apply: The term "ball mark" shall refer to the depression formed in the turf by ball impact. The term "divot" shall refer to a piece of turf gouged out with a club while making a stroke.

The background art reveals a number of multi-purpose golf tools. The tools disclosed, however, consist basically of familiar, expected, and obvious structural configurations, notwithstanding the myriad of designs encompassed by the crowded prior art that have developed for the fulfillment of countless objectives and requirements. There exists a need in the art for an improved multipurpose/multifunctional golf tool that may be used to assist a golfer in accomplishing a wide variety of tasks. In these respects, the present invention substantially departs from the conventional concepts and designs of the prior art, and in doing so provides an apparatus primarily developed for the purpose of providing a multi-purpose golf tool that overcomes the limitations and disadvantages present in the art.

BRIEF SUMMARY OF THE INVENTION

The present invention overcomes the limitations and disadvantages in the art by providing an improved multi-functional golf tool having a handle portion formed at its proximal end, and a pair of prongs formed at its distal end and disposed in angular relation with the handle to provide a ball mark repair tool. In a preferred embodiment the angular relation between the handle and prongs is approximately 25-degrees) (25°) to facilitate the pivotal movement of the golf tool in repairing ball marks or other irregularities on the playing turf, and further provides pivotal leverage when the tool is reversed to aid in removing tees embedded in the ground. The handle portion includes a top that includes a semi-circular slotted edge adapted to receive a ball marker in secure snap-fit relation therewith. The handle includes a top side that defines a longitudinally aligned, generally U-shaped structure disposed at the handle distal end thereof approximately mid-length on the device that serves multiple functions, such as a thumb-rest, cigar holder, and club grip holder. In a corresponding position on the bottom side of the device a contoured surface runs in a transverse direction thereby providing a comfortable support for the user's index finger. The proximal end of the handle includes a projecting tab that functions as a club face scraper for removing dirt and debris, as well functioning as an opening tool for use with ring-pull tab opening mechanisms commonly found on aluminum drinking cans. The projecting tab further includes opposing left and right thin edge projections that function as clubface groove cleaning structures. Alternate embodiments including a belt clip holder and hat visor clip holder are also disclosed.

Accordingly, it is an object of the present invention to provide a golf tool that is useful in a number of functions in which a golfer engages before, during, and after a round of golf.

Another object of the present invention is to provide such a tool which functions to repair ball marks, remove tees, maintain clubs and cigars off wet grass, open beverage containers, clean club faces and grooves, and removably hold a ball marker.

Yet another object of the present invention is to provide such a tool that is designed ergonomically to increase leverage and degree of comfort when in use.

In accordance with these and other objects, which will become apparent hereinafter, the instant invention will now be described with particular reference to the accompanying drawings.

BRIEF DESCRIPTION OF THE SEVERAL VIEWS OF THE DRAWINGS

FIG. 9 is a bottom perspective view thereof;

FIG. 10 is an exploded side view thereof;

DETAILED DESCRIPTION OF THE INVENTION

With reference now to the drawings, FIGS. 1-13 depict preferred and alternate embodiments of an improved multi-functional golf tool, generally referenced as 10, and clip attachments for use therewith in accordance with the present invention. Golf tool 10 includes a proximal handle end 12 and a distal end 14 that are disposed in angular relation. Proximal end 12 generally functions as a handle and is adapted for ergonomic handling. Distal end 14 defines a pair of prongs, referenced as 16, that function to repair ball marks and remove tees. In a preferred embodiment the angular relation between the handle and prongs is approximately 25-degrees (25°) to facilitate the pivotal movement of the golf tool in repairing ball marks or other irregularities on the playing turf, and further provides pivotal leverage when the tool is reversed to aid in removing tees embedded in the ground. As discussed in greater detail below, golf tool 10 is useful in a number of functions in which a golfer engages before, during, and after a round of golf. More particularly, golf tool 10 provides a multi-functional tool for use in repairing ball marks, removing tees, maintaining clubs and cigars off wet grass, opening beverage containers, cleaning club faces and grooves, and removably holding a ball marker. A further advantage realized by golf tool 10 involves an ergonomic design that maximizes leverage and degree of comfort when in use.

Figure 1:
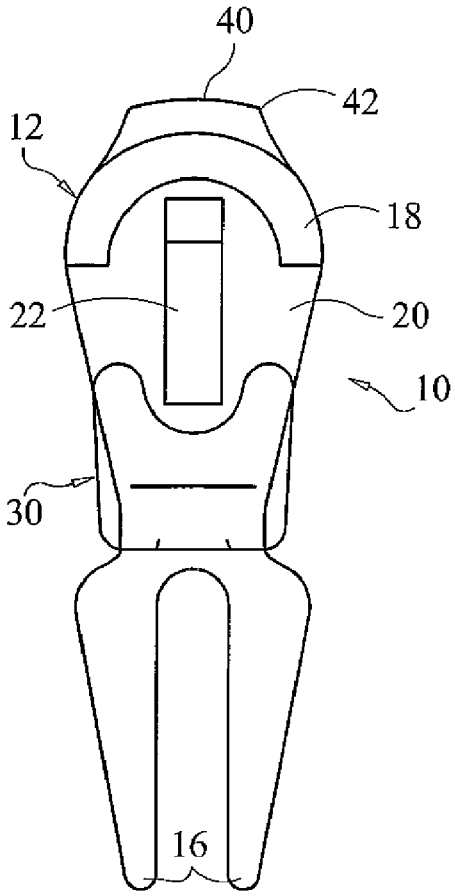
FIG. 1 is a top view of a multi-functional golf tool in accordance with the present invention.
Figure 4:
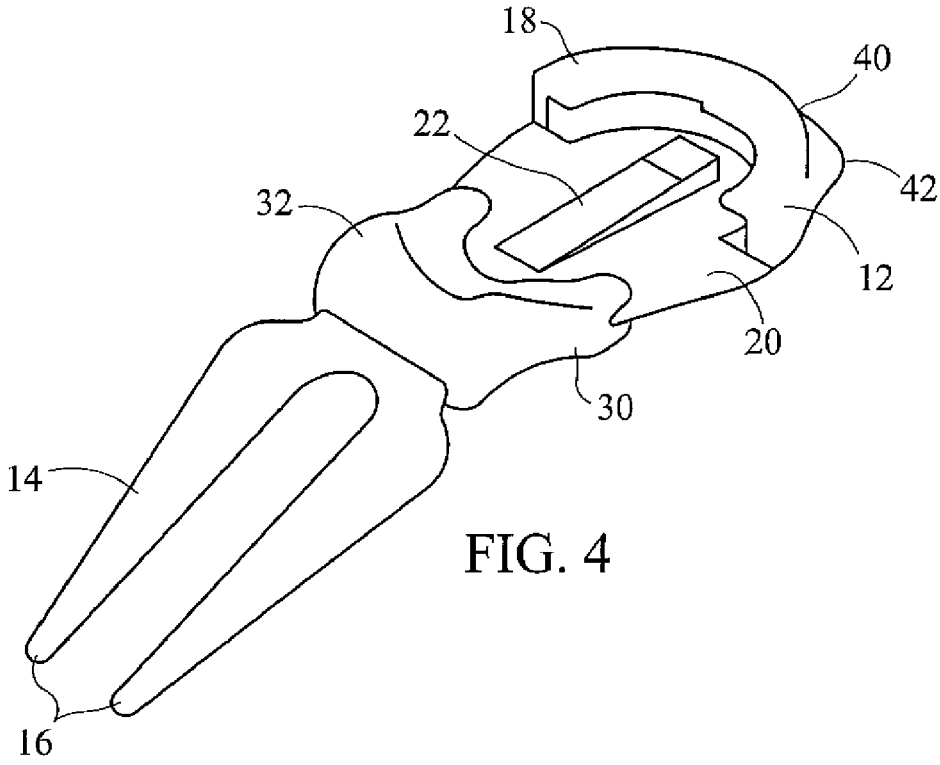
FIG. 4 is a perspective view thereof.
Figure 5:
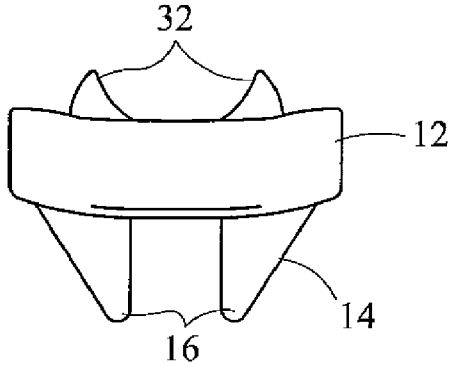
FIG. 5 is a proximal end view thereof.

As best seen in FIGS. 1 and 4, handle 12 includes a top adapted with a semi-circular raised slotted edge 18 adapted to receive a coin-shaped ball marker (not shown) in a ball marker holding area 20 in secure snap-fit relation with tool 10. Ball marker holding area 20 preferably includes a lever 22 that is spring biased to an upward position relative to ball mark holding area 20 to press a ball marker upward in press fit engagement with the semi-circular raised slotted edge 18. This configuration thus maintains a ball marker in relatively secure removable relation with tool 10. The press fit is preferably tight enough to maintain the ball marker within slotted edge 18 while still allowing the user to slidably disengage and remove the ball mark with relative ease. In an alternate embodiment, tool 10 or at least the ball marker holding area 20, is adapted to retain a ball marker by magnetic attraction. Accordingly, the ball marker holding area 20 may further include a magnet for retaining a metallic ball marker. Conversely, the ball marker may include a magnet and the ball marker holding area 20 may include a metallic portion. Various other modifications to the magnetic retaining of the ball marker are considered within the scope of the present invention.

Figure 6:
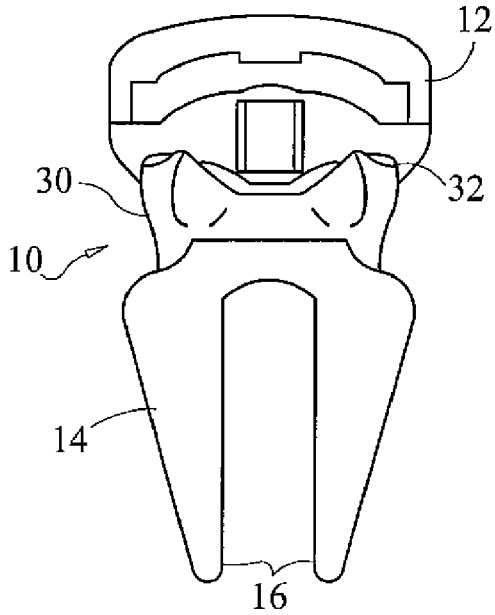
FIG. 6 is a distal end view thereof.

As best seen in FIGS. 1, 4, and 6, handle 12 further includes a topside that defines a thumb rest 30, comprising longitudinally aligned, generally U-shaped structure having projecting lateral sides 32. Thumb rest 30 is disposed on the distal end of handle 12 or approximately mid-length on the device, and serves multiple functions, such as a thumb-rest, cigar holder, and club grip holder. In a corresponding opposing position on the bottom side of the device, a contoured surface 34 runs in transversely across the bottom surface thereby providing a comfortable support for the user's index finger when using the device to repair ball marks.

Figure 2:
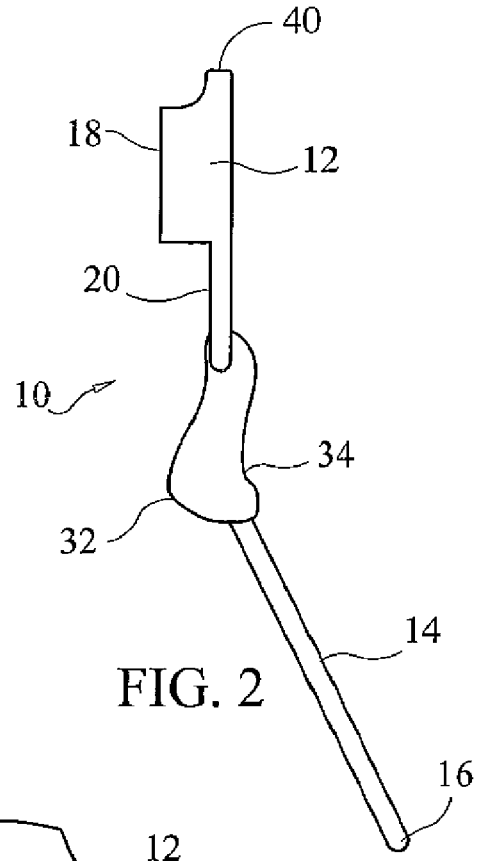
FIG. 2 is a side view thereof.
Figure 3:
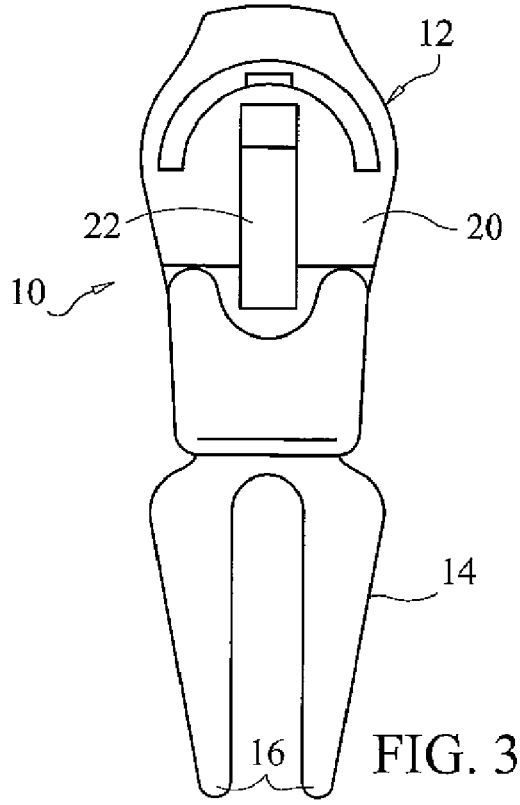
FIG. 3 is a bottom view thereof.

As best illustrated in FIGS. 2 and 4, the proximal end of handle 12 includes a projecting tab 40 that functions as a club face scraper for removing dirt and debris, as well functioning as an opening tool for use with ring-pull tab opening mechanisms commonly found on aluminum drinking cans. Projecting tab 40 further includes opposing left and right thin edge projections 42 that function as clubface groove cleaning structures.

Golf tool 10 provides a compact multi-functional golf accessory. Golf tool 10 may be used to repair ball marks by grasping handle 12 such that the user's thumb is received within thumb rest 30 on the top and the user's index finger is received within the transverse contoured surface 34 on the bottom thereby allowing the user to achieve a firm yet comfortable grip. Ball marks are repaired by inserting the angled prongs 16 into the ground along side the ball mark and pivoting the handle in a vertical direction. Golf tool 10 may also be used to remove golf tees embedded in the ground by inverting the tool, positioning the tool such that the shaft of the golf tee is received between prongs 16 and pivoting the handle downward. In this application, the lateral sides 32 of thumb rest 30 function as the fulcrum of a mechanical lever. As previously noted, golf tool 10 further functions as a ball mark carrier by removably receiving a ball mark on ball mark retaining surface 20 secured by circumferential slotted edge 18 and biased lever 22. Other functions performed by golf tool 10 include using projecting tab 40 to open beverage containers, as well as a scraper for removing dirt and debris from clubfaces. Thin edge projections 42 allow the golf tool to be adapted to clean dirt and debris from the clubface grooves. Finally, the angled handle/prong configuration in combination with the thumb rest structure allows the golf tool to be employed to maintain club grips and/or cigars off of wet grass.

ALTERNATE EMBODIMENT

Figure 7:
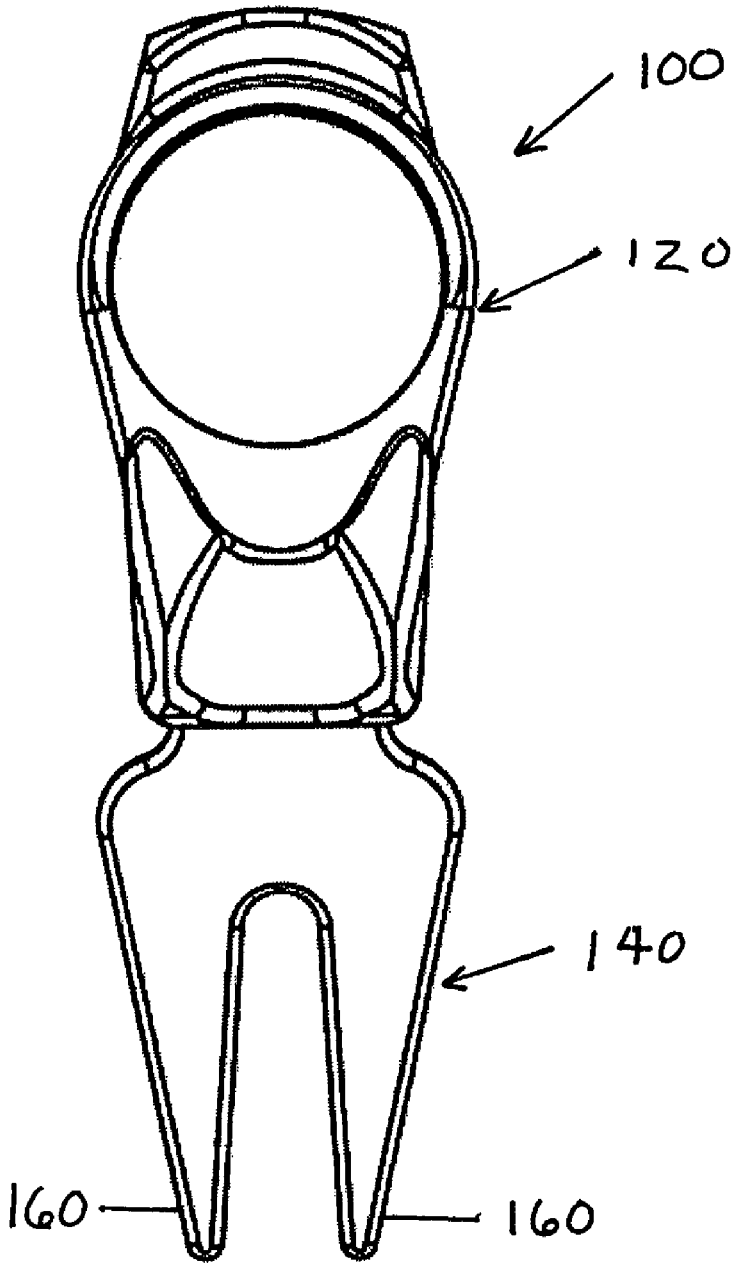
FIG. 7 is a top view of an alternate embodiment multi-functional golf tool in accordance with the present invention.
Figure 8:
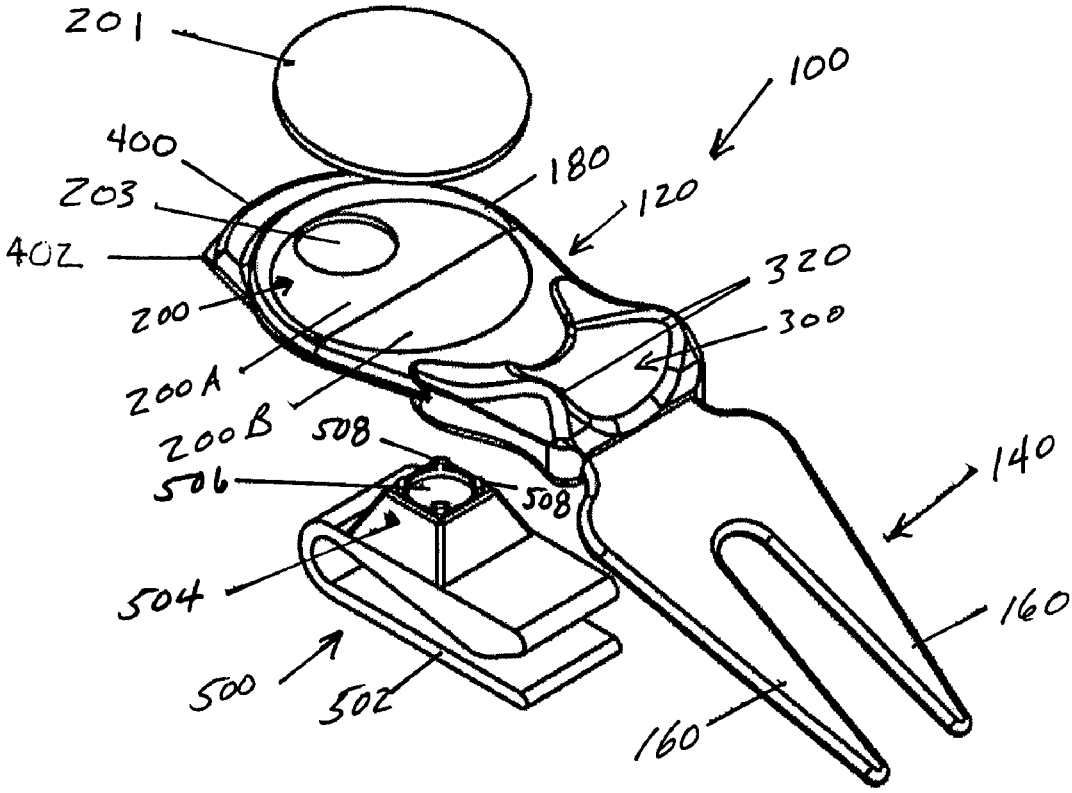
FIG. 8 is an exploded top perspective view thereof showing a ball marker and attachable clip in exploded relation therewith.

FIGS. 7-13 depict alternate embodiments of the present invention. FIGS. 7-9 depict an alternate embodiment golf tool, referenced as 100. Golf tool 100 includes a proximal handle end 120 and a distal end 140 that are disposed in angular relation. Proximal end 120 generally functions as a handle and is adapted for ergonomic handling. Distal end 140 defines a pair of prongs, referenced as 160, that function to repair ball marks and remove tees. In a preferred embodiment the angular relation between the handle and prongs is approximately 25-degrees (25°) to facilitate the pivotal movement of the golf tool in repairing ball marks or other irregularities on the playing turf, and further provides pivotal leverage when the tool is reversed to aid in removing tees embedded in the ground.

In this embodiment, handle 120 includes a top adapted with a circular edge 180 having floor 200 defining a ball mark holding area adapted to receive a metallic circular (e.g. coin-shaped) ball marker 201. Floor 200 includes a magnet 203 for magnetically securing a ball marker 201 within the confines of edge 180. Floor 200 is preferably divided into a first planar portion 200A and a second planar portion 200B in offset recessed relation with first planar portion 200A to allow a user to detach ball marker 201 by lever action upon depressing the portion of the ball mark resting in covering relation with second planar portion 200B. This configuration thus maintains a ball mark in relatively secure magnetic removable relation with tool 100. The magnetic attraction between ball marker 201 and magnet 203 is preferably strong enough to maintain the ball marker within the ball marker holding area still allowing the user to remove the ball marker with relative ease. In an alternate embodiment, the ball marker may include a magnet and the ball marker holding floor 200 may include a metallic portion. Various other modifications to the magnetic retaining of the ball marker are considered within the scope of the present invention.

Handle 120 includes a topside that defines a thumb rest 300, comprising longitudinally aligned, generally U-shaped structure having projecting lateral sides 320. Thumb rest 300 is disposed on the distal end of handle 120 or approximately mid-length on the device, and serves multiple functions, such as a thumb-rest, cigar holder, and club grip holder. In a corresponding opposing position on the bottom side of the device, a contoured surface 340 runs transversely across the bottom surface thereby providing a comfortable support for the user's index finger when using the device to repair ball marks.

The proximal end of handle 120 includes a projecting tab 400 that functions as a club face scraper for removing dirt and debris, as well functioning as an opening tool for use with ring-pull tab opening mechanisms commonly found on aluminum drinking cans. Projecting tab 400 further includes opposing left and right thin edge projections 402 that function as clubface groove cleaning structures.

As with the previous embodiment, golf tool 100 provides a compact multi-functional golf accessory that may be used to repair ball marks, removing tees embedded in the ground, functioning as a ball mark holder, etc. Other functions performed by golf tool 10 include using projecting tab 400 to open beverage containers, as well as a scraper for removing dirt and debris from clubfaces. Thin edge projections 402 allow the golf tool to be adapted to clean dirt and debris from the clubface grooves. Finally, the angled handle/prong configuration in combination with the thumb rest structure allows the golf tool to be employed to maintain club grips and/or cigars off of wet grass.

As best seen in FIGS. 8-10, golf tool 100 may further include an attachable clip, generally referenced as 500. Clip 500 is generally intended for attachment to the visor of a a baseball cap and comprises a generally U-shaped clip body 502 having a projecting golf tool attachment post 504 adapted for magnetic engagement with golf tool 100. More particularly, attachment post 504 includes a top surface having permanent magnet 506 affixed thereto. Magnet 506 functions to magnetically engage a metallic portion of the undersurface of golf tool 100 to allow the tool to be easily attached and removed. In the alternative the position of magnet 506 may be reversed, namely magnet 506 may be affixed to the underside of golf tool 100, and a metallic disc may be affixed to top surface of attachment post 504 on clip 500. A further aspect of the present invention involves providing attachment post 504 with a plurality of projecting posts, referenced as 508. Projecting posts 508 are intended for mating engagement with corresponding mirror image detents formed on the underside of golf tool 100 to prevent undesirable rotational movement between golf tool 100 and clip 500.

Figure 11:
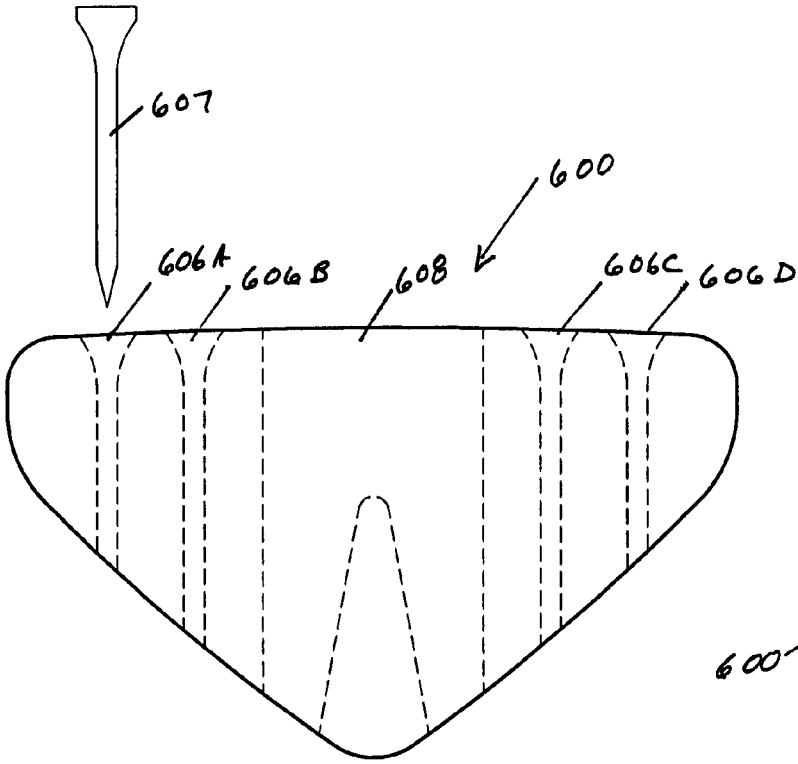
FIG. 11 is a front view of a belt clip for use with a golf tool in accordance with the present invention.
Figure 12:
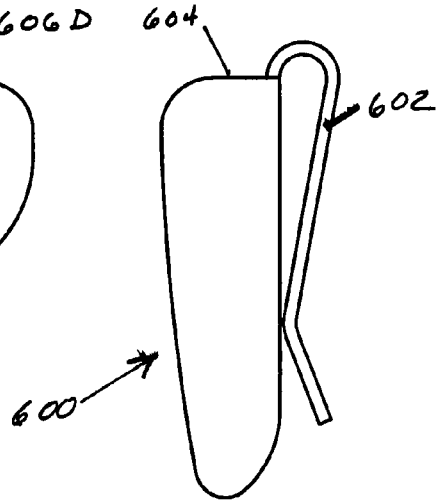
FIG. 12 is a side view thereof.
Figure 13:
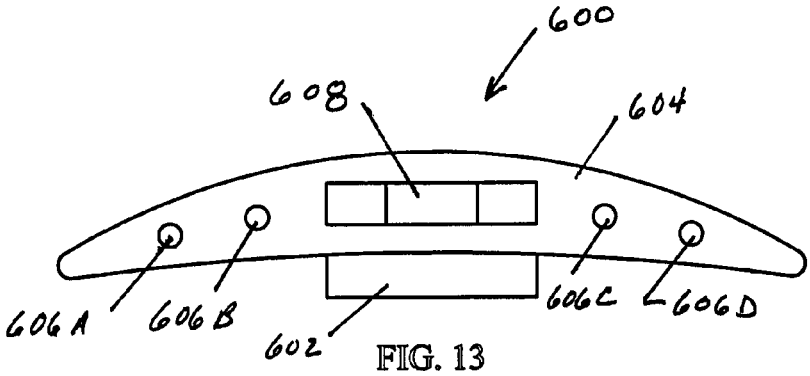
FIG. 13 is a top view thereof.

In still another alternate embodiment depicted in FIGS. 11-13, the present invention contemplates providing a belt-mounted golf tool holder, generally referenced as 600, for providing a removable belt-mounted holder for golf tool 100. Belt holder 600 is preferably fabricated from a soft plastic material and includes a clip 602 for allowing the holder to be easily secured to a user's belt. Holder 600 includes a top 604 defining a plurality of openings, including a first set of openings, referenced as 606A-C sized and shaped for receiving golf tees 607. The top 604 of holder 600 further defines a generally rectangular opening 608 for receiving golf tool 100 insertedly received therein. As should be apparent, holder 600 functions as a belt-mounted holster for golf tool 100 and a plurality of golf tees 607.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A multi-functional golf tool for use while playing a round of golf, said golf tool comprising:

a body including a handle end, and a distal end disposed in angular relation with said handle end, said distal end defining a pair of prongs;

said handle end having a top portion including means for receiving a ball marker in removable secure relation therewith;

said handle end top portion further including a generally longitudinally aligned U-shaped structure having upwardly projecting opposing lateral sides providing a thumb rest, and a corresponding opposing bottom portion defining a contoured surface traversing across the bottom and sized for receiving the index finger of a user;

said handle including a longitudinally projecting tab that functions as a club face scraper for removing dirt and debris, as well functioning as an opening tool for use with beverage opening mechanisms commonly found on aluminum drinking cans;

said tab including opposing left and right thin edge projections that function as clubface groove cleaning structures;

a holder adapted for magnetic connection to said golf tool body, such that said golf tool body is configurable from an attached configuration to a detached configuration;

means for preventing rotational movement of said golf tool relative to said holder when the golf tool is in the attached configuration; and said means for preventing rotational movement includes a plurality of projecting posts in mating engagement with a corresponding plurality of detents.

2. A multi-functional golf tool according to claim 1, wherein said holder includes a clip.

3. A multi-functional golf tool according to claim 1, further including a holder adapted with a clip for attachment of said holder to a user's belt, said holder including a top surface defining an opening for receiving said golf tool insertedly therein and at least one additional opening sized and shaped for receiving a golf tee.

4. A multi-functional golf tool according to claim 1, wherein said means for receiving a ball mark in removable secure relation therewith includes said handle end defining a semi-circular raised slotted edge adapted to receive a coin-shaped ball mark in a ball mark holding area in secure snap-fit relation, said ball mark holding area including a lever that is spring biased to an upward position relative to said ball mark holding area to press said ball mark upward in press fit engagement with said semi-circular raised slotted edge.

5. A multi-functional golf tool according to claim 1, wherein said means for receiving a ball mark in removable secure relation therewith includes a raised circular edge and a floor defining a ball mark holding area adapted to receive a metallic ball mark, said floor including a magnet for magnetically securing said ball mark within the confines of said edge, said floor being divided into a first planar portion and a second planar portion in offset recessed relation with first planar portion to allow a user to detach said ball mark by lever action upon depressing a portion of the ball mark resting in covering relation with said second planar portion.

6. A multi-functional golf tool for use while playing a round of golf, said golf tool comprising:

a body including a handle end, and a distal end disposed in angular relation with said handle end, said distal end defining a pair of prongs;

said handle end having a top portion including means for receiving a ball marker in removable secure relation therewith;

said handle end top portion further including a generally longitudinally aligned U-shaped structure having upwardly projecting opposing lateral sides providing a thumb rest, and a corresponding opposing bottom portion defining a contoured surface traversing across the bottom and sized for receiving the index finger of a user;

said handle including a longitudinally projecting tab that functions as a club face scraper for removing dirt and debris, as well functioning as an opening tool for use with beverage opening mechanisms commonly found on aluminum drinking cans;

said tab including opposing left and right thin edge projections that function as clubface groove cleaning structures;

a holder magnetically connectable to said golf tool body, such that said golf tool body is configurable from an attached configuration to a detached configuration, said holder including a clip;

said holder and said golf tool body incorporating a plurality of projecting posts and a corresponding plurality of detents sized and positioned for receiving the posts when said golf tool body is in said attached configuration to prevent relative rotational movement between said holder and said golf tool body.

* * * * *